United States Patent [19]

Wood

[11] Patent Number: 4,633,643

[45] Date of Patent: Jan. 6, 1987

[54] GUIDE MECHANISM FOR LOADING CARTONS

[75] Inventor: Prentice J. Wood, Hapeville, Ga.

[73] Assignee: The Mead Corp., Atlanta, Ga.

[21] Appl. No.: 304,187

[22] Filed: Sep. 21, 1981

[51] Int. Cl.[4] ..... B65B 39/02

[52] U.S. Cl. ..... 53/248

[58] Field of Search ..... 53/248, 249, 255

[56] References Cited

U.S. PATENT DOCUMENTS 3,911,647 10/1975 Hartness ..... 53/248

4,171,603 10/1979 Wiseman ..... 53/248

*Primary Examiner*—A. J. Heinz

*Attorney, Agent, or Firm*—B. J. Powell

[57] ABSTRACT

The invention provides a loading finger for a drop loading mechanism which finger incorporates a guide plate. In a drop loading grid set the loading fingers define passageways through which bottles are dropped into the cells of cartons. In order to protect the partitions between adjacent carton cells during drop-loading, opposed loading fingers which are located in adjacent passageways have guide plates which include upper portions overlapped with one another above the uppermost edge of a carton partition during drop loading and include lower portions which are spaced apart one on either side of and below the uppermost edge of a carton partition.

10 Claims, 8 Drawing Figures

42
38
40
52
10
20
26
14
22
18
62
32
5
36
24
34
64
66
64a
6
B
D
30
C
X 54
18
14
32
16
56
22
20
48
46
24
To X
BOTTLE
50
52
60
58
62
66
To Y
BOTTLE

32
A
48
46
X
BOTTLE
C
52
50
B
62
66
BOTTLE
Y

GUIDE MECHANISM FOR LOADING CARTONS

BACKGROUND OF THE INVENTION

This invention relates to guide mechanisms for use in drop loading articles into the cellular compartments of cartons and, more particularly, for loading bottles into such cartons by way of the so-called drop loading technique.

The technique itself is well known; for example, U.S. Pat. No. 3,788,034 (Hartness et al) discloses a grid set for use on a bottle loading machine. The Hartness arrangement includes means for positioning bottles in aligned rows above the grid set and means for positioning empty cases below the grid set to receive the bottles. The grid set incorporates drop loading fingers which engage the sides of the bottle as it is dropped into a carton. The loading fingers aid in properly opening the individual compartments of the carton to be loaded, direct the bottles into those compartments and retard the acceleration experienced by the bottles during drop loading so that the bottles are deposited gently in the carton. However, a persistent problem in mechanisms of this type has been that of avoiding damage to the upstanding partitions defining the cells of the carton. The damage normally occurs when the base of the bottle strikes the partition. The problem is accentuated in the case where an empty carton presented for loading is warped or not set up in square condition.

The Hartness construction utilizes a set of four loading fingers for each carton cell. The fingers of each set have angled flange portions which extend outwardly to engage the corners of the carton cell to ensure that the cell is extended properly for receiving a bottle. However, in many basket-style cartons, the partition construction is such that the top edge of a partition extends horizontally from the longitudinal medial partition outwardly for a distance which is at least equal to the transverse width of the carton cell, whereafter the partition is cut away so that the top edge is inclined downwardly towards the adjacent side wall of the carton. The transition between the horizontal and inclined portions of the partition top edge forms a shoulder which can present an obstruction to a bottle being inserted in an adjacent cell. It is not normally practical to redesign the shoulder since to do so would provide inadequate material for preventing contact between bottles in those adjacent cells. The flanges of the loading fingers in the Hartness construction are not designed to give adequate protection to the partitions, particularly in the shoulder region, during the loading operation.

U.S. Pat. No. 3,908,339 (Kennedy et al) discloses a guide mechanism which went some way towards alleviating the problem of cell misalignment by providing a set of four essentially rigid spring biased drop loading fingers for each cell rather than flexible drop fingers used in some previous constructions. However, these known drop fingers also do not succeed in achieving an acceptable degree of protection against damage to the cell partitions.

U.S. Pat. No. 4,171,603 (Wiseman) discloses a grid mechanism for use in drop loading articles. Wiseman recognizes that the space between the bottle wall and the associated cell wall of the carton is extremely limited, and states that the drop loading fingers in order to be present in the cell when the bottle is situated therein must be either located at the corners of the cell or, if located parallel to the cell walls, be extremely thin. The solution offered by the Wiseman disclosure is to provide only a pair of opposed guide members for each cell and this also does not achieve adequate protection for the cell partitions.

SUMMARY OF THE INVENTION

One aspect of the present invention provides a guide member for a drop loading mechanism adapted to guide articles into a carton during a drop loading procedure, which member comprises an elongate finger having, at one of its ends, shank means for connecting the finger to the other components of the mechanism and further comprises a pair of flanges defining a back face and a front face, said flanges extending outwardly from the axis of the finger substantially at right angles to one another whereby the flanges meet to form a corner spine extending centrally along said back face, each flange terminating in a free edge remote from said corner spine, said edge tapering axially towards the other end of the finger and wherein one flange is extended outwardly from said axis relative to the other flange to form an axially tapered guide plate.

Another aspect of the invention provides a guide mechanism for use in drop loading articles into cellular cartons, which mechanism comprises a set of four elongate guide members pivotally connected together at an upper end such that the members are pivotable from a first position in which they are divergent in the direction of their opposite lower ends with respect to one another about the central axis of the set, to a second position in which they are substantially parallel to said central axis, wherein each of two opposed guide members includes a planar guide plate extending outwardly in opposite directions to one another in substantially parallel planes about a plane containing the central axis, each guide plate having a free edge which tapers toward the lower end of that guide member and which extends beyond the maximum limits of a notional boundary which could be generated by rotating the other of the opposed guide members about said central axis.

Yet another aspect of the invention provides, in a grid set for an article loading machine which grid set comprises a plurality of parallel support members spaced apart sufficiently for allowing articles to pass therebetween, a multiplicity of sets of guide members pivotally attached at spaced locations to each of said support members, thereby forming a grid arrangement, each set of guide members comprising two pairs of elongate downwardly extending fingers and in which the juxtaposed fingers of neighboring sets together define a square passageway through which an article passes for loading into a carton by pivotally displacing said fingers from a first closed position in which a lower portion of said fingers extend inwardly towards the center of said passageway, to a second open position in which said fingers are upstanding adjacent the corners of said passageway, the improvement comprising a guide plate provided by each of two opposed fingers defining said passageway, said guide plates extending in opposite directions to one another and generally aligned with said support members, wherein the opposed guide plates in adjacent passageways have a configuration such that when their respective fingers are displaced into said second open position, upper portions of said opposed guide plates are overlapped in face-to-face relationship above a position which would be occupied by the uppermost edge of a carton partition and are spaced apart below that position one on either side of said partition.

These and other features and advantages of the invention disclosed herein will become more apparent upon consideration of the following specification and accompanying drawings wherein like characters of reference designate corresponding parts throughout the several views and in which:

These figures and the following detailed description disclose specific embodiments of the invention; however, it is to be understood that the inventive concept is not limited thereto since it can be incorporated in other forms.

DETAILED DESCRIPTION OF ILLUSTRATIVE EMBODIMENTS

Figure 1:
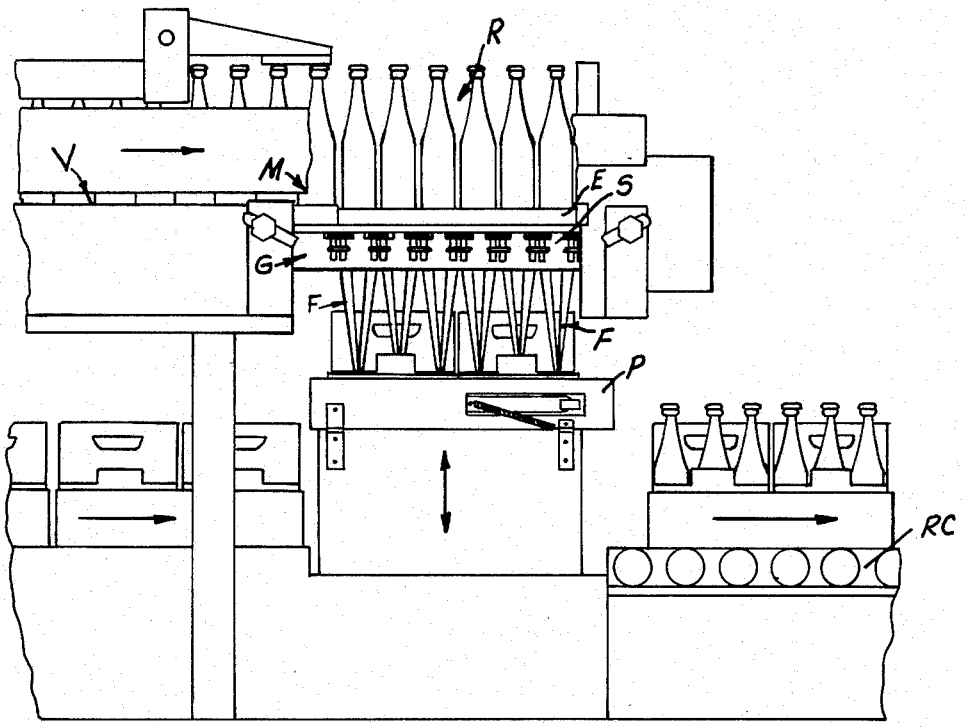
FIG. 1 is a side view general arrangement of a loading machine having a grid set.

Referring first to FIG. 1, there is illustrated a general arrangement of a known apparatus for loading bottles into cartons. The apparatus comprises a grid set G and means M located about the grid set for positioning bottles in aligned rows. Means P is also provided for positioning cartons below the grid set G to receive the bottles. The grid set includes a plurality of parallel elongate supports bars S spaced apart sufficiently for allowing the bottles to pass therebetween. The support bars carry a plurality of sets of loading fingers F defining square passageways forming a grid network through which the bottles pass for loading into the cartons as described in more detail hereinafter. The means M for positioning the bottles about the grid set G includes a conveyor V which feeds the bottle rows R onto a plurality of elongate bars E. When it is desired to load a carton with the bottles carried above the grid set G, bottle support bars E are shifted laterally allowing the bottles to drop through the grid set G into the carton below. The carton in then lowered from the loading position shown in FIG. 1 to be transferred on a receiving conveyor RC.

Figure 2B:
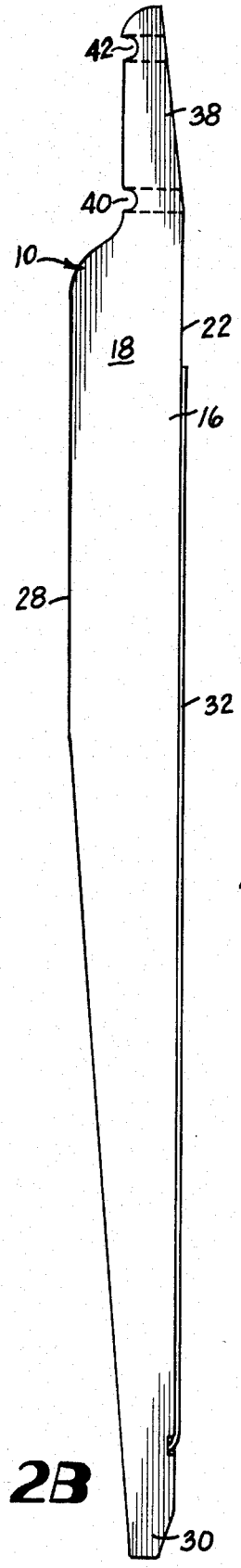
FIG. 2B is a side view of the same drop loading finger showing the back face of the other flange of the finger.
Figure 2C:
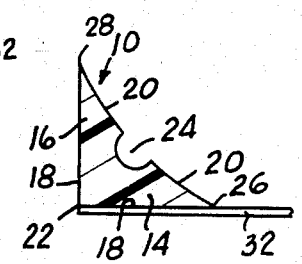
FIG. 2C is a cross-sectional view taken generally along line 2C—2C in FIG. 2A.
Figure 2A:
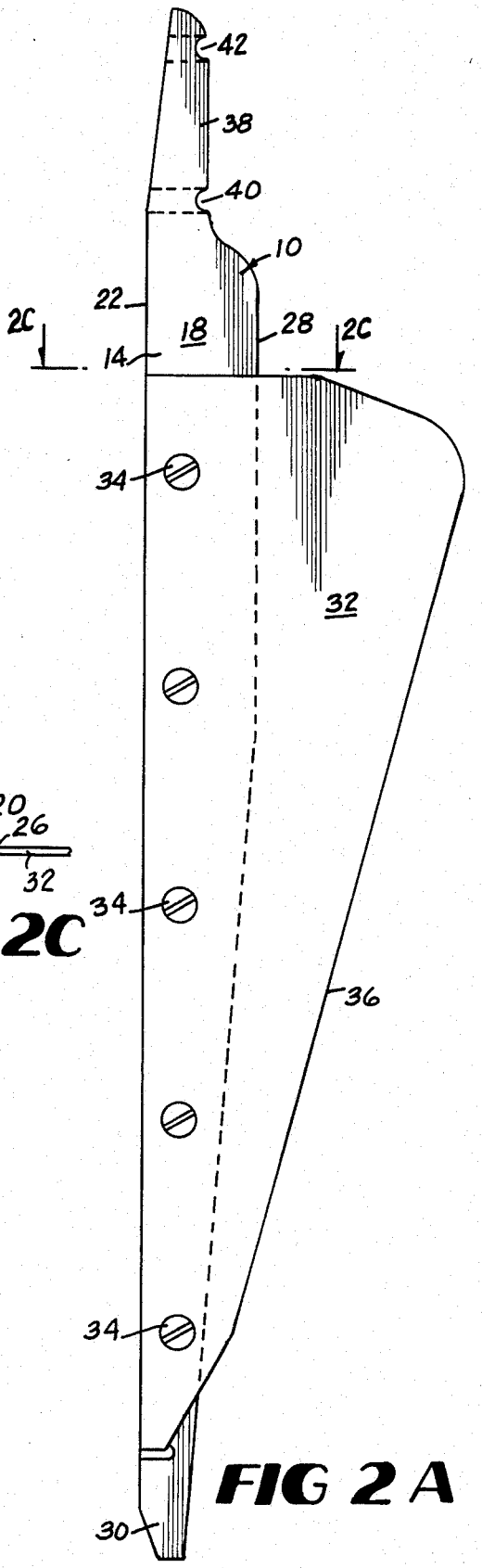
FIG. 2A is a side view of a drop loading finger showing the back face of one flange of the finger which incorporates a guide plate.

This invention is directed to the construction of the loading fingers used in the grid set to guide the bottles into the cartons. FIGS. 2A, 2B and 2C illustrate an elongate loading finger 10 embodying the invention to be used in the sets of fingers in the grid set G to guide bottles into the cartons during a drop loading procedure.

The elongate loading finger 10 comprises a pair of integral flanges 14, 16 respectively which together define a back face 18 and a front face 20 of the finger. The flanges 14, 16 extend outwardly from the axis of the finger substantially at right angles to one another and meet to form a corner spine 22 extending centrally along the back face.

The surfaces of each flange at the back face 18 are flat whereas the surfaces of each flange at the front face 20 are arcuate, thus giving the front face a concave configuration when viewed axially of the finger as seen in FIG. 2C. The front fact 20 is formed with a central groove 24 extending along the length of the finger opposite the spine 22 and which separates the arcuate front face 20 into two sections. The arcuate front face is formed so that the flanges 14, 16 terminate in sharp free edges 26, 28 respectively. The free edges 26, 28 extend parallel to one another at the upper end of the finger and then converge towards the tip 30 of the finger so that the finger is tapered toward its tip. At the upper end of finger 10, the flanges merge to form an integral shank 38. The shank 38 is formed with a lower arcuate groove 40 and an upper arcuate groove 42 used to assemble the fingers 10 in sets.

In the embodiment illustrated in FIGS. 2A–2C, the flange 14 carries a generally deltoid planar guide plate 32. The guide plate is fastened to the back face of flange 14 by suitable fasteners 34, the internal ends of which are secured by suitable means, for example, an epoxy resin within central groove 24. The guide plate 32 has a free edge 36 which is tapered towards the tip 30 of the finger so that the maximum width of the guide plate is adjacent the upper end of the finger. However, in a preferred embodiment of the invention, the guide plate 32 is formed integrally with the loading finger, preferably by moulding, and therefore forms an extended portion of flange 14. In either case, both the thickness and maximum width of the guide plate 32 is an important consideration as will become apparent. As will become more apparent, the guide plate 32 serves to protect the carton and prevent interference between the bottle and the carton as the carton is loaded.

The loading fingers 10 are typically arranged in sets of four in the grid set G. When four of the fingers embodying the invention are assembled, two fingers 10 provided with guide plates 32 and two fingers 10 without guide plates 32 are typically used as will become more apparent. These four fingers are arranged in the set so that one pair of diametrically opposed fingers is provided with guide plates 32 while the other diametrically opposed fingers have no guide plates. The guide plates 32 project outwardly from the fingers in opposite directions to one another. These finger sets are designed for use in protecting the partitions in cartons which form two sides of a carton cell. If it is desirable to protect more sides of the carton cell, then guide plates 32 may be provided on more of the fingers so that a guide plate 32 is provided for each side of the carton cell to be protected.

It will be apparent that the free edge 36 of each guide plate 32 of the opposed fingers in the set extends beyond the maximum limits of a notional boundary which could be generated by rotating the other opposed fingers about the central axis of the set. Such a notional boundary would, of course, be defined by the free edges of the flanges on those fingers in the set which are without guide plates. Hence, the maximum limits of that boundary would correspond to the diameter of a circle described by the free edges of the (other) opposed flanges at their maximum width.

The mounting of the set of fingers 10 is conventional and will now therefore be only briefly described. The set of fingers 10 is mounted in a locking ring (not shown) carried by one of the support bars S in the grid set G seen in FIG. 1 in known manner. The shanks 30 on fingers 10 are inserted into the locking ring on either side of the support bar so that the back faces 18 of the fingers are positioned to face one another with the respective arcuate grooves 40 and 42 on the fingers in the set aligned to form a pair of annular recesses. The locking ring fits within the lower grooves 40 and a locking plate, also known per se, is inserted between the fingers 10 at right angles to the support bar to keep the locking ring in the lower grooves 40. A garter compression spring, also known per se, is snapped into the upper grooves 42 and around the locking plate to complete the assembly of the set of fingers.

It will be seen that the spine of the shank 38 is inclined towards the front face 20 of the finger relative to the finger axis in the region which extends between the lower arcuate groove 40 and the axial extremity of the shank. Thus, when the four fingers are connected together to form a set, the fingers are pivotable about the locking ring towards and away from the junction between the support bar and locking plate. The garter compression spring is sized to bias the finger shanks towards the junction between the support bar and locking plate, that is, towards the central axis of the set. Hence, the fingers are spring biased to normally diverge outwardly of the central axis with respect to one another in a direction away from their mutual pivotal connection. It will be appreciated that the fingers can be pivoted inwardly toward the central axis of the set so that the spines 22 thereon are generally parallel to the central axis of the set where the guide plates 32 on the opposed pair of fingers lie in substantially parallel planes about a plane containing the central axis of the set.

Figure 3:
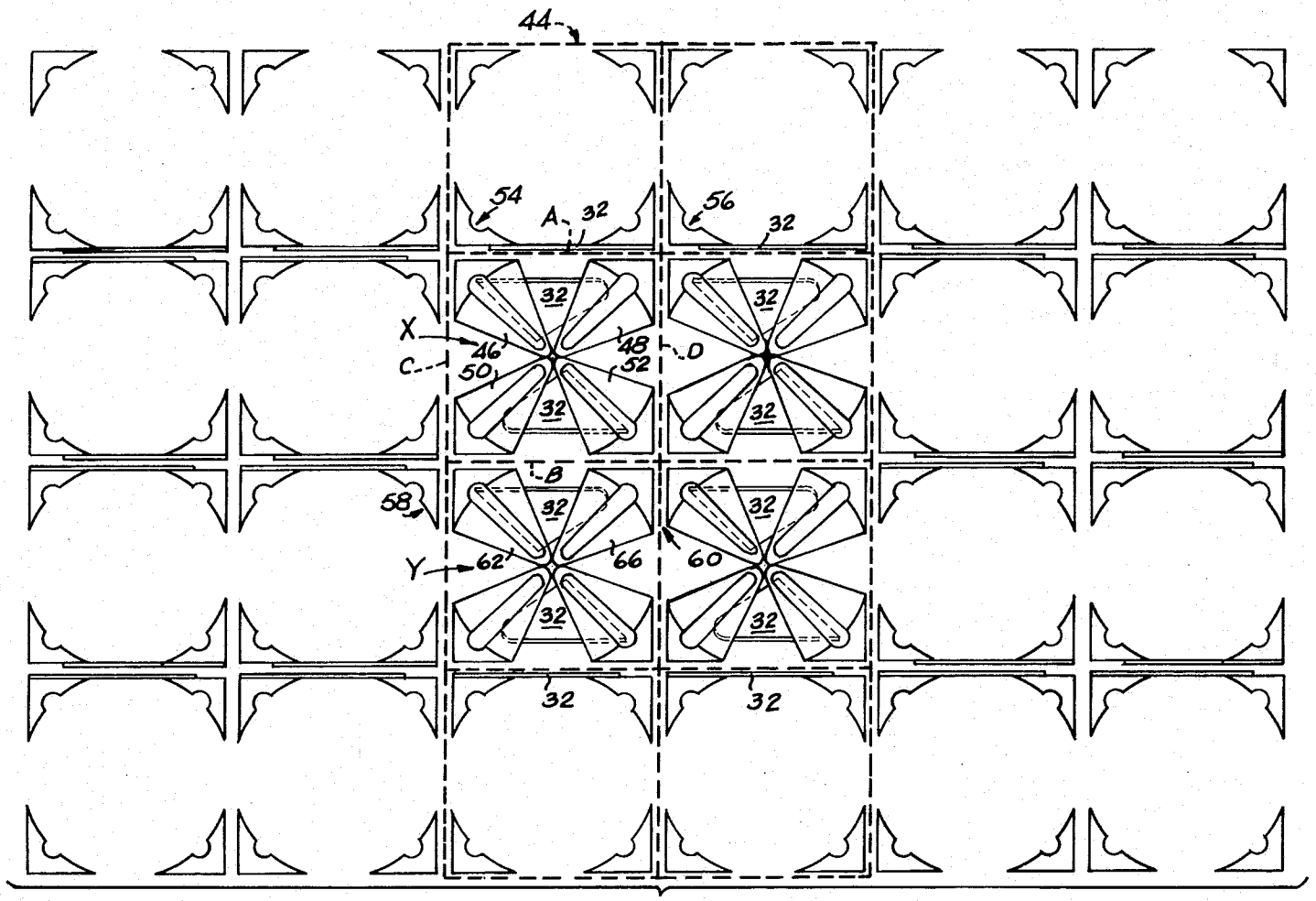
FIG. 3 is a schematic plan view of a grid set arrangement incorporating sets of loading fingers according to the invention.

As an example, FIG. 3 shows schematically a grid finger arrangement in plan suitable for loading bottles into three basket-style cellular cartons, known per se, and each of which is adapted to receive eight bottles where each of the partitions in the carton is to be protected. It will be appreciated that the invention is not limited to this particular grid arrangement since it may be incorporated in any grid arrangement designed to load bottles in cellular cartons. The three cartons, of which only the center one is shown by dashed lines, are located vertically beneath the grid arrangement in a parallel side-by-side relationship and aligned such that the longitudinal axis of each carton extends transversely with respect to the support bars for the loading finger sets and the finger guide plates 32. Thus, the upstanding partitions which separate the bottle receving cells of each carton and which are to be protected extend parallel to the finger guide plates 32 with one of the finger guide plates being provided for each partition in each cell. Since the side walls, end walls, and median wall of these particular cartons do not need protection, no guide plates are provided for these walls. In the particular arrangement shown, there is a total of thirty-six finger guide plates 32 which is the number required to satisfactorily shield the internal transverse partitions of the three cartons during the bottle loading operation. It will be appreciated that each finger in each set of fingers extends into a different carton cell and each finger in the set cooperates with one of the fingers of three other sets of fingers to guide a bottle into the carton cell as is known in the art.

For purposes of explanation, the centermost carton in the grid arrangement is shown in position in broken lines and designated reference 44. All the loading fingers 10 except those which are located for loading the central four cells of the center carton 44 are shown in their open loading position. The central loading fingers for the four cells of carton 44 are illustrated in their closed position immediately prior to the gravity loading operation. In use, it will be appreciated that all of the cells in the cartons would be substantially simultaneously loaded so that all of the fingers would be in about the same position at the same time.

Prior to bottle loading, each carton to be loaded is brought into a position beneath the grid finger arrangement while the fingers are in the closed position and moved up under the grid set so that the closed loading fingers are received within the carton cells. When the bottles are dropped onto the fingers, they force the fingers into their open positions to guide the bottles into the carton cells.

The bottle loading operation will now be described with reference to carton cell X in carton 44 which is defined by transverse partitions A and B, side wall C, and medial partition D, all of which are shown in broken lines in FIG. 2. Reference also is made to the adjacent cell Y. The arrangement is such that four loading fingers are accommodated in each cell and each finger so accommodated is comprised in a different one of the sets. For purposes of identification, the loading fingers which are accommodated in cell X are referenced 46, 48, 50 and 52 and are included in four different finger sets identified as 54, 56, 58 and 60 respectively. Therefore, the juxtaposed fingers of neighboring sets together define a square passageway through which a bottle passes for loading into the carton. Fingers 62 and 66 which also are included in sets 58 and 60 respectively are received in cell Y adjacent partition B. The fingers 46, 52 and 62 are provided with guide plates 32 while fingers 48, 50 and 66 have no guide plates.

The loading fingers 46, 48, 50 and 52 are disposed within cell X such that the upper portion of each finger is located in a respective one of the cell corners as illustrated. When closed, the fingers extend downwardly and converge inwardly of cell X so that the lower portions of the fingers form a closed array centrally of cell X. Thus, the inward (front) faces of loading fingers 46, 48, 50 and 52 interfere with the loading path through the passageway to cell X. When the grid is actuated to permit a bottle to be released and drop downwardly under gravity towards cell X, the bottle heel strikes against the inward facing surfaces of the loading fingers 46, 48, 50 and 52. As the bottle engages the fingers, its weight forces the loading fingers 46, 48, 50 and 52 simultaneously outwardly against the resilience of their pivotal spring loading so that they are brought into an open position in which each finger is caused to adopt a substantially upright position in the respective corners of the cell X. It is to be understood that all the bottles are dropped simultaneously and therefore a similar displacement of the fingers in neighboring cell Y also occurs. Hence, when in the open position, the respective finger guide plates 32 of fingers 52 and 62 are brought into face-to-face relationship with opposite sides of transverse partition B of the carton as will be described in more detail with reference to FIG. 4. By this action, the gravity acceleration experienced by the bottle in each cell is retarded by the loading fingers and each bottle, therefore, is seated gently in its respective carton cell. Since the outward displacement of the loading fingers occurs in each cell substantially simultaneously, it will be appreciated that the loading fingers bring the structural components of the carton forming the cell into a squared up condition during loading.

Figure 4:
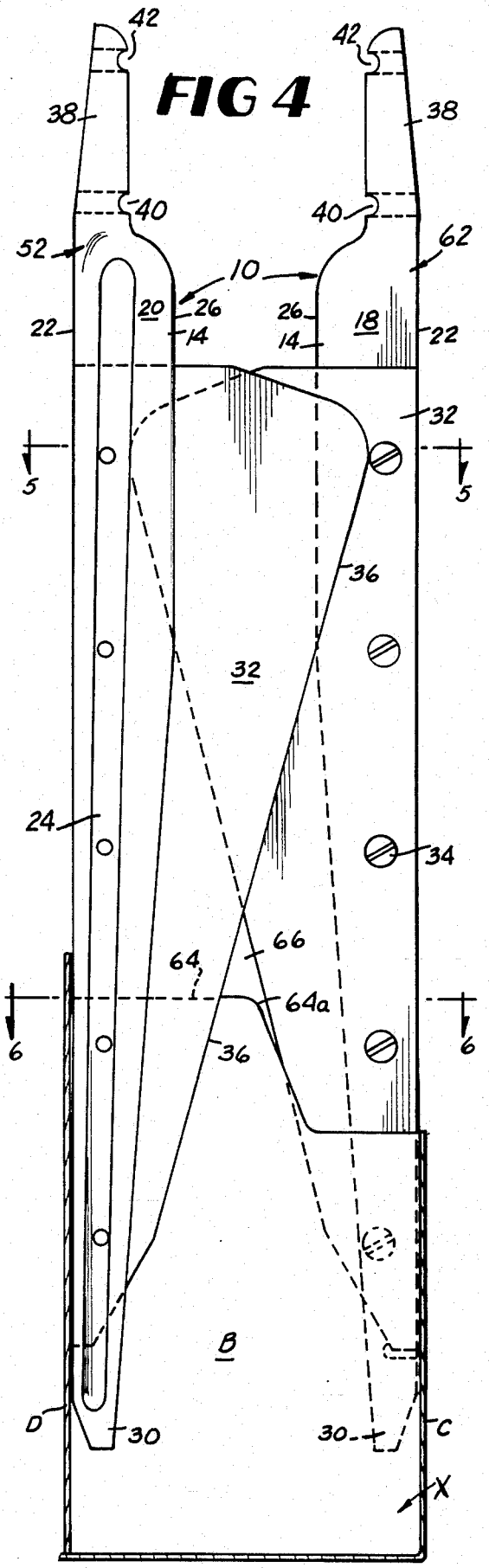
FIG. 4 is an end view of a pair of cooperating loading fingers shown displaced into their relative positions about a carton cell partition to permit drop loading.
Figure 5:
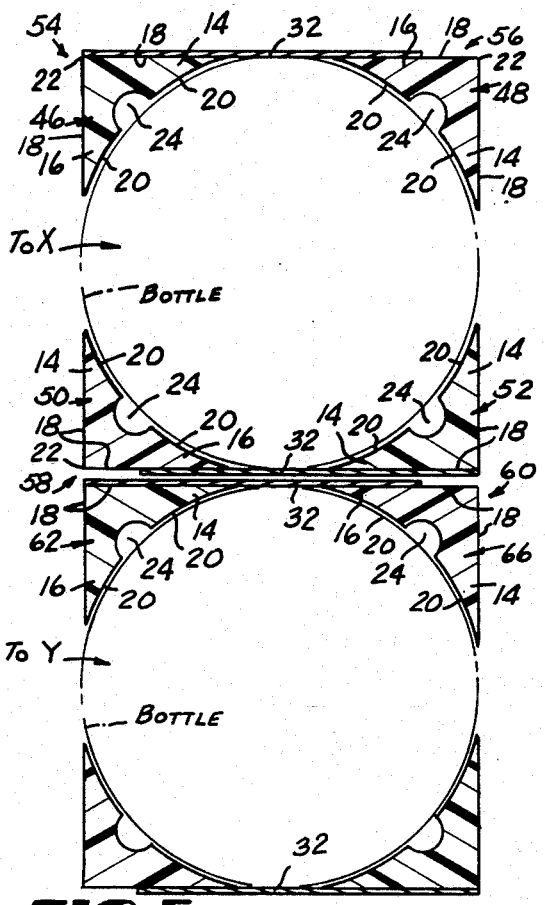
FIG. 5 is a cross-sectional view taken generally along line 5—5 in FIG. 4.
Figure 6:
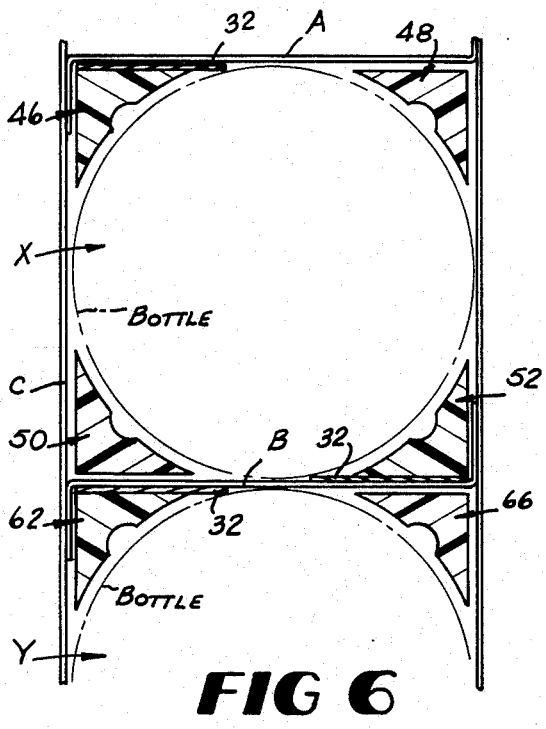
FIG. 6 is a cross-sectional view taken generally along line 6—6 in FIG. 4.

FIGS. 4–6 of the drawings show in detail loading finger 62 located adjacent partition B in carton cell Y and loading finger 52 located adjacent partition B in carton cell X when in their open positions. Finger 62 is comprised in set 58 and finger 52 is comprised in set 60. Sets 58 and 60 are adjacent sets which may be mounted on the same grid support bar. When loading fingers 62 and 58 are displaced into their open position as shown in FIG. 4, the respective guide plates 32 are brought into face-to-face relationship with opposite sides of the partition B. The upper portions of the guide plates 32 are overlapped with one another above the top edge 64 of partition B and the lower portions of guide plates 32 are located in spaced relationship one on each side of partition B.

The degree of taper given to the free edge 36 of each guide plate 32 is chosen so that when the loading fingers 52, 62 are in their open positions shown in FIGS. 4–6, the cooperating guide plates are overlapped with one another only in that region which is above the top edge 64 of partition B and thereafter are divergent with respect to one another. Thus, above the top edge 64 of partition B, each guide plate 32 extends across that portion of the bottle likely to come into contact with the top edge of partition B to locate the bottle so that it will clear the top edge 64 of partition B as seen in FIG. 5 but clears this portion of the bottle just before it reaches the top edge of partition B to prevent binding between the bottle, guide plate 32 and partition B within the cell as seen in FIG. 6.

This positional relationship between the cooperating guide plates provides shielding of the interadjacent partition B against damage by an incoming bottle and/or prevents the bottle being arrested by engagement of the bottle heel against the partition top edge 64 (and particularly shoulder 64*a*) but without unduly decreasing the size of the loading passageway through which each bottle is to travel. In this regard, it will be appreciated that if the guide plates were overlapped within the vicinity of and on either side of the partition B, the thickness of material constituted by both cooperating guide plates 32 and the partition B itself would reduce the loading passageway dimension in cells X and Y. The accumulative effect of such a situation at each carton partition would be likely to so reduce the bottle-to-cell dimensional tolerance so as to seriously impede the loading operation and the subsequent withdrawal of the loading fingers from the cell. The arrangement shown in which a relatively small gap 66 between the guide plates is present immediately above the shoulder 64*a* of top edge 64 has been found satisfactory to ensure reliable bottle loading since the gap does not expose a sufficient amount of the top edge 64 of the partition to cause an obstruction to the loading operation.

For a similar reason, it is desirable that the combined thickness of a pair of guide plates within each set should not exceed the thickness of the grid support bar from which that set of guide fingers is suspended. In this regard, it will be apparent that when the loading fingers of a set are displaced into their open position, the flanges of those fingers which carry a guide plate are brought into abutting relationship one on either side of the common grid support bar. Therefore, the thickness of the guide plates should be chosen so that the guide plates are accommodated with the space occupied by the grid support bar to ensure that the fingers are fully displacable during loading. Further, there should be a slight space between the guide plates when the fingers are in their open position so that the upper portions of the guide plates can be displaced slightly towards each other to allow the bottle to freely pass thereby as it drops toward the carton cell.

It will further be seen that the upper portions (that is, at its widest region) of each guide plate 32 are sufficiently wide to extend at all times behind the flange of the next adjacent finger within the carton cell in which the guide plate is located. This insures that the guide plate 32 will not interfere with the opening and closing of the adjacent guide fingers and also insures that the guide plate 32 will be maintained so that the bottle heel will not hang on the top edge of the guide plate as it is lowered. This width of the upper portion of the guide plate 32 also causes this portion of the guide plate to project behind the flange on the finger mounting the guide plate on the opposite side of the partition in the adjacent cell. Hence, at their upper portions, the free edges of the guide plates are trapped between two opposed loading fingers in adjacent cells. This feature prevents undue flexing of those loading fingers which include a guide plate. Such flexing could otherwise create an unacceptable stress on the shank of a loading finger which may result in fracture in the region of the pivotal connection. This feature can best be seen by reference to FIGS. 4 and 5 where the guide plate 32 on finger 52 extends behind the flange on the adjacent finger 50 in cell X and behind the finger 62 in cell Y. Guide plate 32 on finger 62 in cell Y extends behind the flange on the adjacent finger 66 in cell Y and behind the finger 52 in cell X.

What is claimed as invention is:

1. A guide member for a drop loading mechanism adapted to be used in sets to guide articles into a cellular carton during a drop loading procedure in which the sets of guide members have a first portion extending into the cells past the tops of the carton partitions and a second portion located above the carton partitions, said guide member comprising an elongate loading finger having upper and lower ends and a central axis, said finger including shank means at the upper end for connecting said finger to the drop loading mechanism and a pair of flanges defining a back face and a front face thereon, said flanges extending outwardly from the axis of the finger substantially at right angles to one another whereby said flanges meet to form a corner spine extending centrally along said back face, each flange terminating in a free edge remote from said corner spine and tapering axially from the upper end towards the lower end of said finger, one of said flanges defining an outwardly projecting axially tapered guide plate portion projecting from the upper end of said flange a distance greater than the distance between adjacent sets of said guide members so that the upper end of said plate portion overlaps the back face of a loading finger in the adjacent set, said guide plate portion tapering inwardly toward the lower end of said finger so that said plate portion has a width less than one-half the distance between adjacent sets of fingers at the top of the carton partitions.

2. A guide member according to claim 1 wherein said back face of said flanges is flat and said front face of said flanges is concave when viewed axially of said finger.

3. A guide member according to claim 2 wherein said flanges at the front face of said finger each define an arcuate face thereon defining a sharp free edge along said flange remote from said axis, a central groove defined in the front face of said finger and extending along the length of said finger separating said arcuate faces on said flanges.

4. A guide member according to claim 1 wherein said guide plate portion is a separate guide plate attached to the back face of said one flange.

5. A guide member according to claim 1 wherein said guide plate portion is formed integrally with said one flange.

6. In a grid set for an article loading machine to load cartons separated into cells by partitions with upper edges which grid set comprises a plurality of parallel support members spaced apart sufficiently for allowing articles to pass therebetween, a multiplicity of sets of loading fingers pivotally attached at spaced locations to each of said support members, thereby forming a grid arrangement, each set of loading fingers comprising two pairs of elongate downwardly extending fingers and in which the juxtaposed fingers of neighboring sets together define a generally square passageway through which an article passes for loading into a carton by pivotally displacing said fingers from a first closed position in which a lower portion of said fingers extend inwardly towards the center of said passageway, to a second open position in which said fingers are upstanding adjacent the corners of said passageway, the improvement comprising a guide plate provided on each of two opposed fingers defining said passageway, said guide plates extending in opposite directions to one another and generally aligned with said support members, said guide plates being tapered with a generally deltoid configuration so that opposed guide plates in adjacent passageways have a configuration such that when their respective fingers are displaced into said second open position, upper portions of said opposed guide plates are overlapped in face-to-face relationship a prescribed distance above a position occupied by the uppermost edge of the carton partition and are spaced apart therebelow with one of said plates on either side of said partition so that the partition is maintained in position yet the article can pass between said guide plates without binding at the partition.

7. The grid set according to claim 6 wherein said upper portion of each said guide plate within a passageway is overlapped outwardly of the adjacent one of the other two opposed fingers defining that passageway.

8. The grid set according to claim 7 wherein said juxtaposed fingers are spring biased into said first closed position.

9. The grid set according to claim 8 wherein said guide plates in each set of loading fingers have a combined thickness which is not greater than the maximum thickness of the support member to which that set pivotally is attached to insure that the articles will pass thereby during loading.

10. A guide assembly for a drop loading mechanism to guide bottles into a carton with open top rectilinear cells bounded by carton portions when the carton is positioned at a predetermined loading position below the drop loading mechanism, said guide assembly including a plurality of loading fingers pivotally mounted in the drop loading mechanism so that a group of four of said loading fingers is operatively associated with each of the open top cells in the carton in the loading position, each of said loading fingers having an upper portion and a lower portion and oriented so that said upper portion is located above those carton portions bounding the cell associated with the carton in the loading position while said lower portion is located within the cell, said loading fingers in each group associated with a cell in the carton adapted to be pivotally displaced from a closed position in which said lower portions of said loading fingers angle inwardly toward the center of the cell to an open position in which said lower portions of said fingers are located in the cell corners and at a spacing to allow the bottle to pass therebetween into the cell through the open top thereof; certain of said loading fingers including a planar guide plate extending lengthwise of said loading finger and projecting outwardly therefrom toward one of the adjacent loading fingers in the group associated with the same carton cell and oriented so that said guide plate, when said loading fingers are in their open position, is generally coplanar with the carton portion bounding that side of the cell between said finger mounting said guide plate and said adjacent loading finger, said guide plate having upper and lower ends and tapering inwardly from a width greater than the distance between said adjacent loading fingers at the upper end thereof to a width less than one-half the distance between said adjacent loading fingers at the top of the carton portion adjacent said guide plate.

* * * * *